United States Patent [19]

Wilson

[11] 4,423,775

[45] Jan. 3, 1984

[54] LINE STRIPPER

[76] Inventor: James A. Wilson, 2039 Amelia St., Dallas, Tex. 75235

[21] Appl. No.: 270,252

[22] Filed: Jun. 4, 1981

[51] Int. Cl.[3] ..... E21B 33/08

[52] U.S. Cl. ..... 166/84; 277/73

[58] Field of Search ..... 166/77, 82, 84; 277/73

[56] References Cited

U.S. PATENT DOCUMENTS

| | | | |
|---|---|---|---|
| 2,748,870 | 6/1956 | Basham et al. | 166/77 |
| 2,943,682 | 7/1960 | Ingram, Jr. et al. | 166/77 |
| 3,129,009 | 5/1964 | Simpson | 166/82 |
| 3,468,549 | 9/1969 | Wilson | 277/73 |
| 3,626,505 | 12/1971 | Douglas | 277/73 |
| 4,307,783 | 12/1981 | Lanmon | 166/82 |

*Primary Examiner*—Stephen J. Novosad
*Assistant Examiner*—William P. Neuder

[57] ABSTRACT

A wire line stripper having a tubular body with a deformable or plastic packing element disposed therein for sealingly engaging an elongate flexible member, such as a wire line or a cable, which is longitudinally movable through the body and the packing element, an operator means such as a tubular piston in the body for forcing the packing element at several longitudinally spaced locations resiliently radially inwardly toward the flexible member, and a safety sleeve secured to the stripper and extending thereabove which limits flexure or bending of the flexible member and minimizes abrasion thereof as it moves downwardly into or upwardly from the body. The safety sleeve has an annular outwardly extending flange for protecting members externally connected to the body, such as fittings through which fluid under pressure is admitted into the body to operate the operator means, against damage thereto during installation, removal or operation of the stripper.

2 Claims, 7 Drawing Figures

LINE STRIPPER

This invention relates to well tools and more particularly to line strippers.

In well operations, various well tools such as logging devices, casing perforators, plugs, packers and the like, have to be lowered into and then raised from a well flow conductor, such as the tubing or casing of a well, by means of an elongate flexible member, such as a wire line or electric cable. During upward movement of the flexible member from such tubing or well casing, the flexible member must be wiped or stripped of well fluids, mud or other matter which may be adhering to it.

It is conventional to employ a line stripper, such as the one illustrated and described in U.S. Pat. No. 3,228,703, issued Jan. 11, 1966, to J. A. Wilson, connected to the top end of such well fluid conductor to wipe or strip well fluids, mud or other substances from the flexible member as it is drawn upwardly from a well flow conductor.

During installation, operation and removal of such line stripper, the flexible member above the body of the line stripper may be displaced laterally of the line stripper causing it to engage the top surfaces of the line stripper and also to bend at the location of such engagement. If the radius of the bend is small, damage to the flexible line may occur, particularly if it is an insulated cable having electric conductors extending to the device connected to the bottom end of the line. In addition, if the surfaces of the stripper engaged by the line are sharp or rough additional damage to the flexible line may occur due to abrasion.

Also, during such installation operation and removal operations, devices connected to and extending outwardly of the body of the line stripper may be damaged by forcible contact with other wellhead devices during relative movement between the line stripper and such other devices.

It is desirable therefore that a line stripper be provided which has means for limiting the degree or radius of flexure of the flexible line at the location of its entry or exit from the line stripper and provide a smooth arcuate surface slidably engageable at such location by the line to minimize abrasion of the line.

Also, it is desirable that the line stripper be provided with means protecting elements connected to and extending laterally outwardly of the line stripper body from damage during installation, operation and removal of the line stripper.

According, it is an object of this invention to provide a new and improved line stripper for stripping or wiping well fluids and the like from a flexible elongate member or line as it is drawn upwardly from a well flow conductor.

Another object is to provide a line stripper having a tubular elongate body connectible in longitudinal axial alignment with and to the top end of a well conductor which extends into a well bore, a tubular resilient packing or stripping means through which the line may move, an operator means for compressing the stripping means into sealing and stripping engagement with the line, and a safety sleeve or bonnet extending upwardly and outwardly of the stripper and providing an upwardly and outwardly extending guide and slide surface engageable by the line in the event of relative lateral movement between the top end of stripper and the line to limit the radius of the bend in the line and minimize abrasion of the line due to sliding contact with the stripper.

An important object of the invention is to provide a line stripper of the type described, wherein the guide and slide surface is provided by a safety sleeve or bonnet releasably connected to the operator means of the stripper and extending upwardly therefrom.

Another object is to provide a line stripper of the type described, wherein the safety bonnet is provided with an external annular flange at its top end which extends outwardly of the line stripper to protect hydraulic fittings connected to the exterior of the line stripper body.

Still another object is to provide a line stripper of the type described wherein the components thereof which are subject to wear, due to engagement thereof by the line during its movement therepast, are easily replaceable without requiring disconnection of the stripper body from the well conductor.

Additional objects and advantages of the invention will be readily apparent from the reading of the following description of a device constructed in accordance with the invention and reference to the accompanying drawing thereof, wherein.

Figure 1:
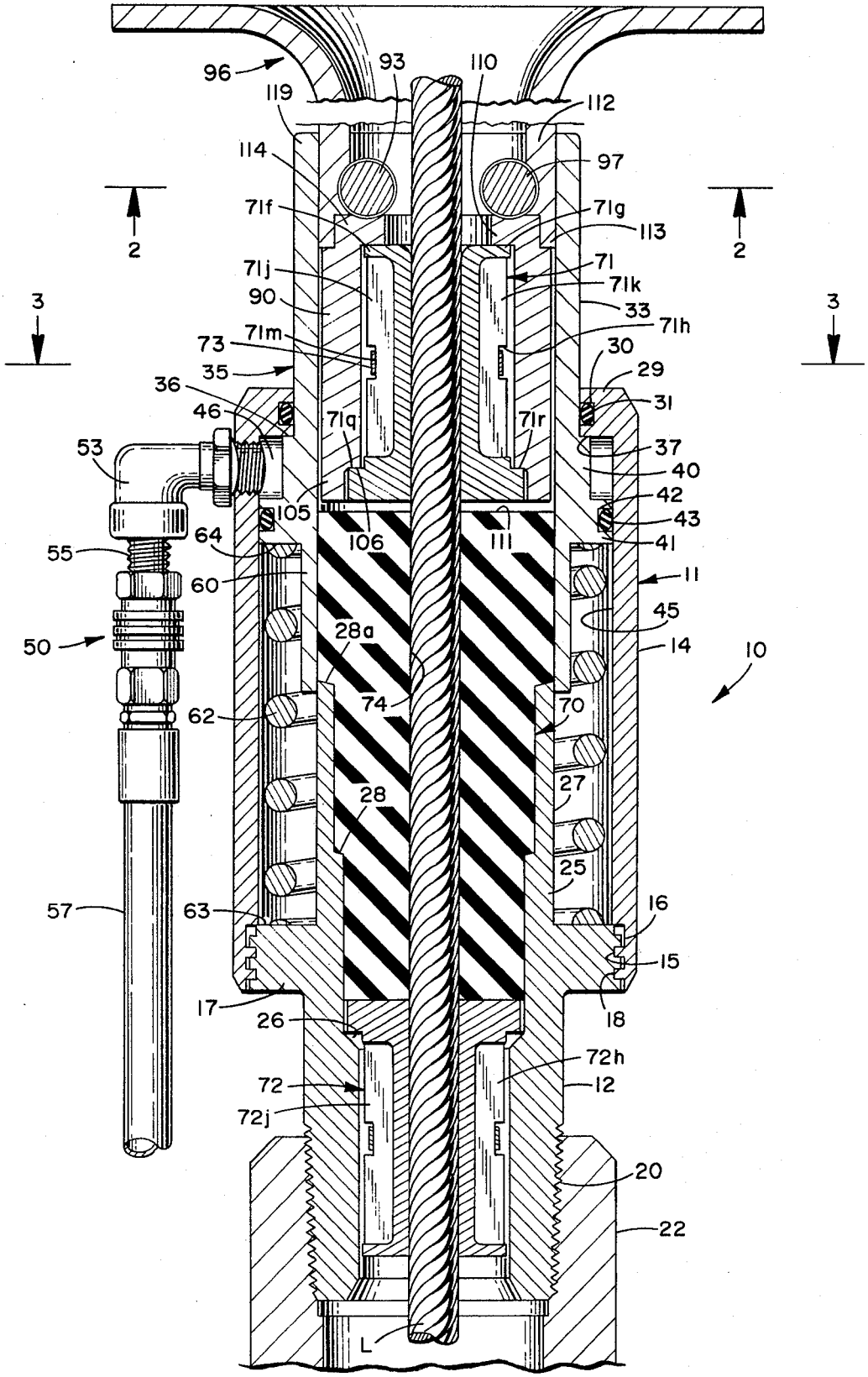
FIG. 1 is a longitudinal sectional view of the line stripper embodying the invention.
Figure 2:
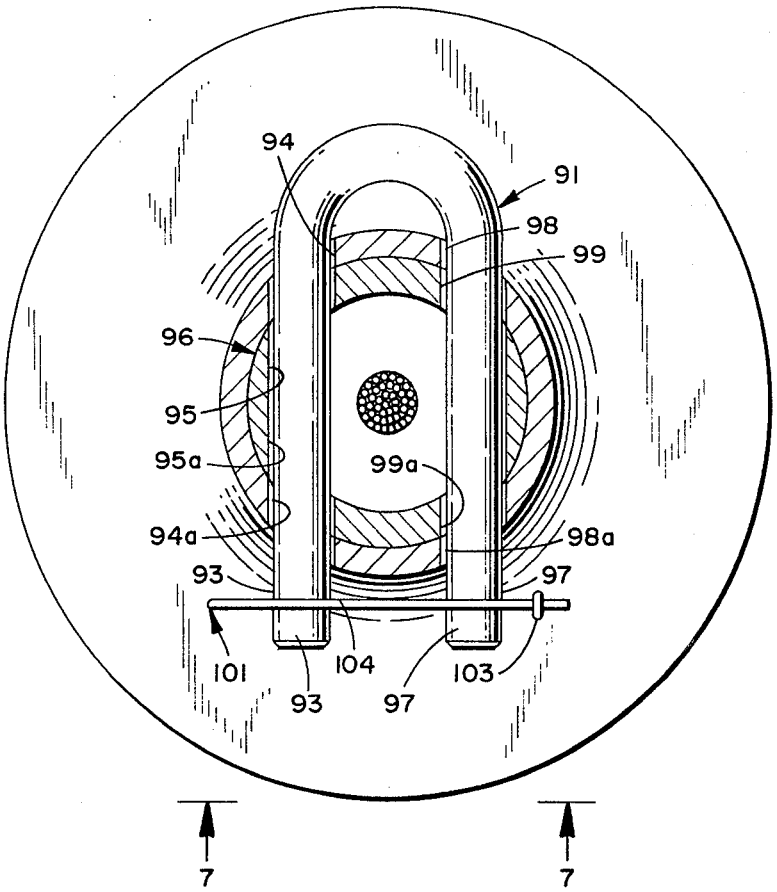
FIG. 2 is a sectional view taken on line 2—2 of FIG. 1.
Figure 3:
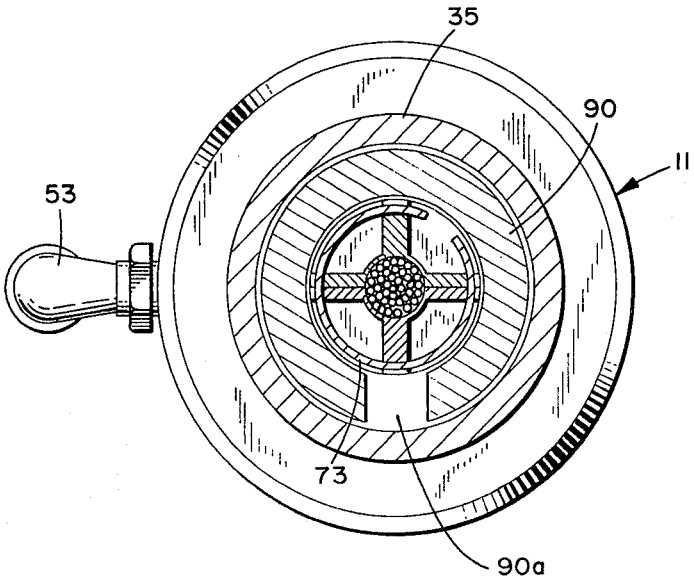
FIG. 3 is a sectional view taken on line 3—3 of FIG. 1.
Figure 4:
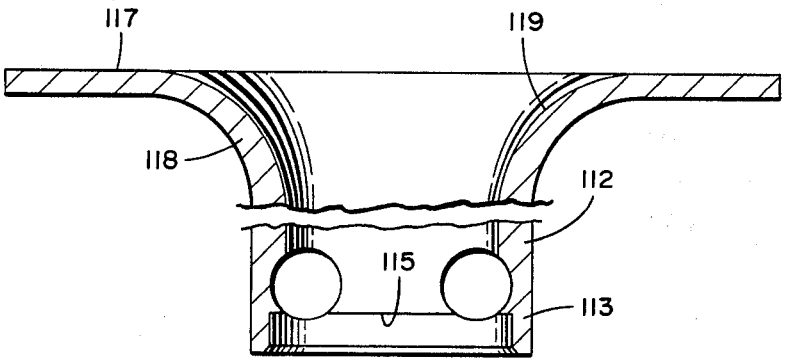
FIG. 4 is a longitudinal sectional view of the bonnet.
Figure 5:
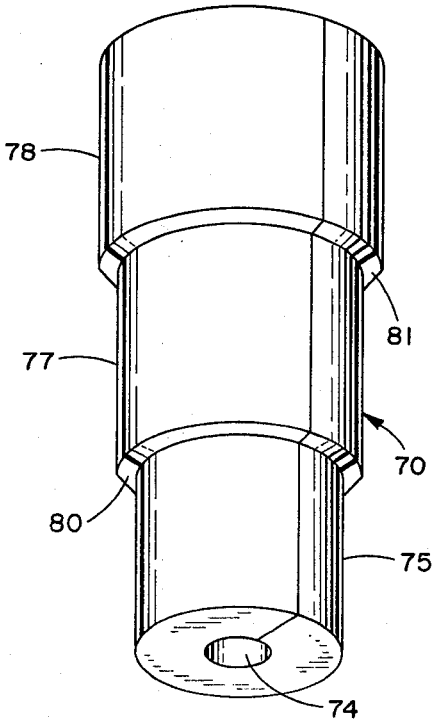
FIG. 5 is a perspective view of the packing element of the stripper.
Figure 6:
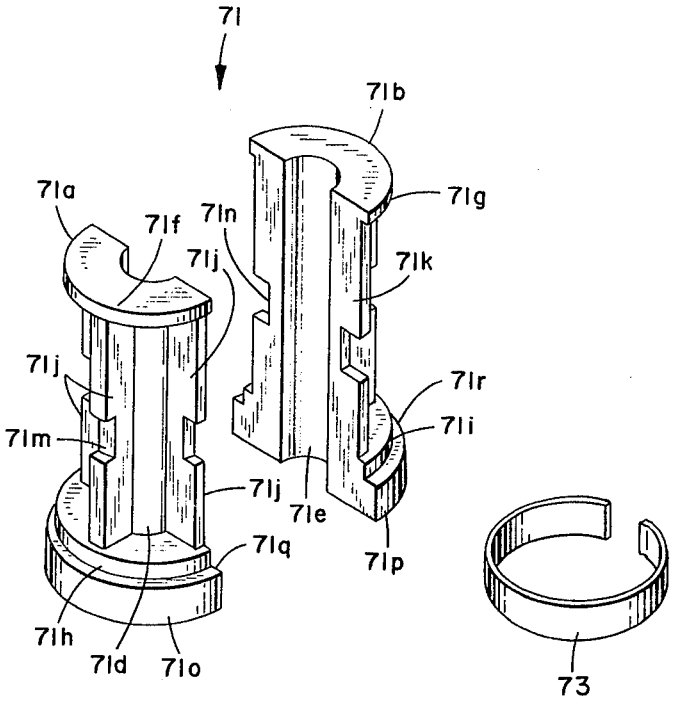
FIG. 6 is an exploded perspective of a bushing assembly of the stripper; and, FIG. 7 is a fragmentary view taken on line 7—7 of FIG. 2.
Figure 7:
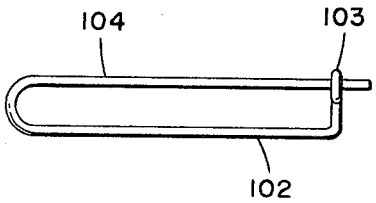

Referring now to the drawings, the line stripper 10 includes an elongate body 11 having a tubular bottom section 12 and a top section 14 threadedly connected together, as at 15, by external threads 16 of the external flange 17 of the bottom section and the internal threads 18 at the bottom end of the top section.

The bottom section is externally threaded as at 20 whereby it may be connected in the top end of a well conductor, such as at tubing 22.

The bottom body section 12 has an intermediate portion 25 of enlarged internal diameter which provides an upwardly facing annular stop shoulder 26 and a top portion 27 of still greater internal diameter which provides a downwardly and inwardly inclined annular compression surface or shoulder 28 at its lower end. The top end of the bottom body section also has a similar downwardly and inwardly inclined annular compression surface **28*a*** for a purpose to be described herebelow.

The top body section is provided with an internal annular flange 29 having an internal annular recess 30 in which is disposed an O-ring 31 which seals between the flange and the external seal surface 33 of a tubular piston 35.

The tubular piston 35 is mounted for limited longitudinal movement in the stripper body, its upward movement relative to the stripper body being limited by the engagement of its annular upwardly facing annular stop shoulder 36 with the bottom surface 37 of the top flange 29 of the top body section.

The stop shoulder 36 is provided by an external portion 40 of the piston of increased external diameter. An external annular flange 41 at the lower end of the intermediate portion has an external annular recess 42 in which is disposed on O-ring 43 which seals between the piston flange and the internal seal surface 45 of the top body section.

It will be apparent that the pressure of hydraulic fluid admitted into the annular internal chamber 46, formed by the piston and the top body section between the piston intermediate portion 40 and flange 41 and the flange 29 of the top body section, will exert a downward force on the upwardly facing surfaces of the piston between the lines of sealing engagement of the O-ring 43 with the top body section seal surface 45 and of the O-ring 31 with the piston seal surface 33.

Hydraulic fluid may flow into this chamber 46 through a fitting assembly 50 which includes an elbow 53 having one leg connected to the bushing and has a nipple 55 threaded in its other leg. A suitable conventional quick disconnect hydraulic fitting 56 may be employed to connect a flexible conduit 57 to the nipple, the flexible conduit being of course connected to a source of hydraulic fluid under pressure.

The piston has a dependent or bottom portion 60 which telescopes over the top portion 27 of the piston bottom section. A spring 62 disposed in the stripper body biases the piston 35 upwardly, its bottom portion engaging the top surface 63 of the external flange 17 of the body bottom section and its top portion engaging the bottom surface 74 of the piston flange 41.

The piston when it is moved downwardly in the stripper body compresses a tubular packing element 70 between top and between bushing assemblies 71 and 72, respectively. The packing element is formed of a suitable deformable or plastic substance, such as rubber, which may be placed into sealing and wiping engagement with the external surface of a line L which is movable through its central longitudinal bore or passage 64.

The packing element has a bottom portion 75 of the same external diameter as the internal diameter of the bottom body portion 25, a middle portion 77 of the same external diameter as the internal diameter of the body portion 27, and a top portion 78 having the same external diameter as the internal diameter of the piston.

The packing element has downwardly and inwardly inclined annular shoulders 80 and 81 which engage the compression shoulders 28 and **28*a***, respectively, of the bottom body portion.

The top bushing 71 is formed of two identical sections **71*a* and 71*b* which are releasably held in place by spring clip 73**.

The sections **71*a* and 71*b* have semi-cylindrical longitudinally extending walls 71*d* and 71*e*, respectively, semi-annular top flanges 71*f* and 71*g*, respectively, and bottom external semi-annular flanges 71*h* and 71*i*, respectively. The sections also have three vertical ribs 71*j* and 71*k* extending outwardly from the semi-cylindrical walls and between the top and bottom flanges. The vertical ribs 71*j* and 71*k* have recesses 71*m* and 71*n* intermediate their ends in which is received the spring clip 73** to hold the two sections together. It will be apparent that the two sections form a tubular bushing when their facing edge surfaces are held in contact by the spring clip.

The flanges **71*h* and 71*i* have flange portions 71*o* and 71*p* extending radially outwardly therefrom to provide stop shoulders 71*q* and 71*r***, respectively.

The bottom bushing 72 is identical in structure to the top bushing 71 and, accordingly its elements have been provided with the same suffixes, added to the numeral 72, as the corresponding elements of the top bushing.

Upward movement of the packing element relative to the piston 35 is prevented by the top bushing 71, a retainer sleeve 90 and a U-pin 91.

The single piece retainer sleeve has a slot **90*a* large enough to permit it to be installed on the inner line. It also has an outside diameter somewhat smaller than the internal diameter of the piston 35 and is longitudinally slidable therein. Upward movement of the retainer sleeve, however, is limited by the U-pin 91 whose leg 93 extends through aligned apertures 94, 94*a*, 95 and 95*a* in the piston 35 and a safety or bonnet sleeve 96, respectively, and a leg 97 which extends through aligned apertures 98, 98*a* and 99 and 99*a*** in the piston and the safety sleeve, respectively.

A retainer pin 101 similar in shape and construction to a safety pin has a shank 102 which passes through aligned holes in the outer portions of the legs 93 and 96 and is locked in place by spring action by a hook 103 engageable with the other parallel section 104 of the retainer pin.

The retainer sleeve 90 has a reduced bottom portion 105 which provides an internal downwardly facing annular shoulder 106 which is engageable with the stop shoulders **71*q* and 71*r*** of the top bushing sections.

The retainer sleeve has a top internal annular flange 110 whose bottom surface is engageable by the top external flanges **71*f* and 71*g* of the top bushing sections 71*a* and 71*b***, respectively.

The top of the retainer sleeve flange 110 is engageable by the U-pin legs 93 and 97 which thus limit downward movement of the piston 35 relative to the retainer sleeve.

It will be noted that the bottom annular surfaces of the retainer sleeve and of the top bushing section engage the top surface 111 of the packing element so that as the piston is moved downwardly in the stripper body 11, the packing element will be compressed downwardly against the compression shoulders 28 and **28*a* of the bottom body section and against the top surface of the bottom bushing 72**.

The compression shoulders since they are inclined inwardly and downwardly serve to increase the radial forces tending to move and hold the packing in sealing and wiping engagement with the line and also serve to make the such radial forces more uniform throughout the length of the packing element.

The safety sleeve 91 has a cylindrical portion 112 which telescopes into the top end portion of the piston 35 and has a bottom end portion 113 of increased internal diameter which telescopes over the top end portion 114 of the retainer sleeve which is of reduced external diameter. The internal downwardly facing annular shoulder 115 of the safety sleeve may engage the top surface of the retainer sleeve.

The safety bonnet has an outer annular flange or portion 117 which extends substantially perpendicular to the longitudinal axis of the cylindrical portion 112 thereof and is connected thereto by an upwardly and outwardly curved connector portion 118 which provides a smooth arcuate guide surface 119. The smooth arcuate surface of course minimizes abrasion of the line should the upper portion of the line, as it exits from the line stripper be displaced laterally in any direction relative to the stripper. In addition, the bending or radius of curvature of the line will be held within desired limits prescribed by the radius of curvature of the guide surface 119.

In use, the line stripper is connected to the well conductor as illustrated in FIG. 1 and the line L extends therethrough as shown. The top portion of the line is wound about a powered reel or hoist so that it may be moved longitudinally upward through the stripper by the hoist and be allowed to move downwardly therethrough due to the weight of the portion of the line below the stripper and of the well tool attached to its bottom end.

When it is desired to move the line upwardly, hydraulic fluid under controlled pressure is admitted through the flexible coupling and the fitting assembly 50 into the chamber 46 of the stripper. The force of this pressure causes the piston to move downwardly thus compressing the packing element and causing it to engage the wire line through the length of the packing element with a desired radial force.

As the line is moved upwardly, the packing element strips off from the line well fluids, and/or other substances, which may be adhered to the line.

If the apparatus raising or lowering the line for some reason is displaced laterally from its proper position above the stripper, the line above the stripper would be moved laterally so that it would not be in vertical centered position relative to the stripper, but angled upwardly and laterally therefrom. This causes the line to bend as at A. Such bending if the radius of curvature of the bend is less than that at which the stresses and strains of the wire exceed predetermined values will cause the line to be damaged if the safety sleeve or bonnet were not provided.

If the line above the stripper is displaced laterally it will engage the arcuate guide and slide surface 119 which will limit the degree of flexure or bend of the line and will also minimize abrasion to the line because it is smooth.

The packing element when compressed holds the portion of the line engaged by it in vertical central coaxial alignment with the stripper body and the well flow conductor. The bushings are made of a relatively soft metal, such as brass, and will not therefore tend to damage the line if engaged by it.

As the packing element wears away with continued usage due to it being of much softer substance than the line which it engages with compressive force, it has to be replaced periodically.

It will be apparent that this can be easily accomplished without disconnecting the stripper body 11 from the well conductor 12 or the piston 35 from the stripper body or removing the line from the stripper. First the retainer pin 101 is removed from the ends of the legs of the U-pin. The U-pin is then removed. The safety sleeve 96 and the retainer sleeve 90 may then be moved upwardly of the stripper body and the piston end held by any suitable means thereabove with the line passing therethrough. The retainer sleeve may be removed from about the line.

The top bushing is then raised above the top of the piston and also supported thereabove. If desired or convenient the bushing can be removed from about the line since it is in two sections by removing the clip spring 71*c*.

The remainder of the packing element is then removed, such removal being facilitated by a longitudinal slit 130 which extends the length of the packing element. A replacement packing element is then disposed about the line above the piston, again by means of its slit 130 and then slid downwardly on the line into the piston and the stripper body. Finally the top bushing 71, the retainer body and the safety sleeve are successively lowered into position in the piston. Finally the U-pin is slid in place as illustrated and then locked against displacement by the retainer pin 101.

During installation, operation and removal of the stripper the hydraulic fitting assembly 50 because it extends outwardly of the stripper body, may be struck accidentally by other objects or tools, moving or falling downwardly therepast. The flange 117 of the safety sleeve extends outwardly of such assembly so that the flange protects it from such damage.

It will now be seen that a new and improved line stripper has been illustrated and described which is of simple economical construction and is easily installable on and removed from a well flow conductor.

It will also be apparent that the components of the stripper which are subject to wear are easily removable from the stripper and replaceable with new such components without removing the stripper from the flow conductor or removing the line from the stripper.

The foregoing description of the invention is explanatory only and changes in the details of the construction illustrated may be made by those skilled in the art, within the scope of the appended claims without departing from the invention.

What is claimed and desired to be secured by Letters Patent is:

1. A safety sleeve for a line stripper having a tubular body connectable to and in vertical axial alignment with a flow conductor through which a line may move longitudinally into and from the flow conductor, a yieldable tubular packing element positionable about the line and in the body; piston means movable longitudinally relative to the body for compressing the packing element into stripping engagement with the line, and means for introducing fluid pressure into said body for moving said piston means to compress said packing element; said safety sleeve being connectable to said stripper and extending upwardly of said stripper for limiting the radius of flexure of the line if the position of the line above the stripper is displaced laterally from vertical longitudinal alignment with the stripper, said safety sleeve having a bottom cylindrical portion connectable to said stripper, and an upwardly and outwardly extending annular guide portion integral with said cylindrical portion, said guide portion providing an annular arcuate surface curving upwardly and outwardly and being engageable by the line if the line above the stripper is displaced laterally relative to the stripper, such engagement of the guide surface limiting the radius of flexure of the line, said safety sleeve including an integral flange portion extending outwardly from said guide portion in a plane perpendicular to the longitudinal axis of said cylindrical portion, said flange extending outwardly of said stripper.

2. The safety sleeve of claim 1 wherein said guide surface is smooth to minimize abrasion of a line as it slides therealong.

* * * * *